US006502584B1

(12) United States Patent
Fordham

(10) Patent No.: US 6,502,584 B1
(45) Date of Patent: Jan. 7, 2003

(54) MASCARA APPLICATOR ASSEMBLY HAVING INTURNING WIPER FINGERS

(75) Inventor: John F. W. Fordham, Gerrards Cross (GB)

(73) Assignee: Geka Manufacturing Ltd., London (GB)

( * ) Notice: Subject to any disclaimer, the term of this patent is extended or adjusted under 35 U.S.C. 154(b) by 0 days.

(21) Appl. No.: 09/611,699

(22) Filed: Jul. 7, 2000

Related U.S. Application Data

(63) Continuation-in-part of application No. 09/149,578, filed on Sep. 8, 1998, now Pat. No. 6,168,334.

(30) Foreign Application Priority Data

| | | |
|---|---|---|
| Sep. 8, 1997 | (GB) | 9719046 |
| Jul. 7, 1999 | (GB) | 9915947 |
| Mar. 7, 2000 | (GB) | 0005503 |

(51) Int. Cl.[7] ..... A45D 40/26
(52) U.S. Cl. ..... 132/218; 401/122
(58) Field of Search ..... 132/218, 216, 132/313, 317, 320; 401/122, 121, 118, 126, 129, 16

(56) References Cited

U.S. PATENT DOCUMENTS

| | | | | |
|---|---|---|---|---|
| 3,084,374 A | | 4/1963 | Ziegler | |
| 4,175,574 A | | 11/1979 | Zulberti | 132/88.7 |
| 4,194,848 A | | 3/1980 | Kingsford | |
| 4,241,743 A | | 12/1980 | Schnabel et al. | |
| 4,527,575 A | * | 7/1985 | Vasas | 132/88.7 |
| 4,761,088 A | | 8/1988 | Zubek | |
| 5,490,737 A | | 2/1996 | Gueret | |
| 5,509,742 A | * | 4/1996 | Balzarini | 401/17 |
| 5,599,125 A | | 2/1997 | Vasas et al. | |
| 5,709,230 A | * | 1/1998 | Miraglia | 132/218 |
| 5,876,138 A | | 3/1999 | Gueret | 410/129 |
| 5,961,238 A | * | 10/1999 | de Bruin et al. | 401/122 |
| 6,059,473 A | * | 5/2000 | Gueret | 401/129 |

FOREIGN PATENT DOCUMENTS

| | | | | |
|---|---|---|---|---|
| DE | 3542-474 C | * | 5/1987 | 132/218 |
| DE | 37 04496 C1 | | 10/1987 | |
| DE | 296 13996 U1 | | 11/1996 | |
| DE | 197 44 181 A1 | * | 10/1997 | A45D/34/04 |
| DE | 197 44 181 A1 | | 4/1999 | |
| EP | 0 202 932 | * | 3/1986 | A45D/40/26 |
| EP | 0 202 932 | | 11/1986 | |
| EP | 0 204 466 | | 12/1986 | |
| EP | 0 627 182 | | 12/1994 | |
| EP | 0 627 182 A1 | | 12/1994 | |
| EP | 693 263 | | 1/1996 | |
| GB | 1 276 859 | | 6/1969 | |
| GB | 2 097 662 A | | 11/1982 | |
| GB | 2 146 520 | | 4/1985 | |
| GB | 2 158 703 | | 11/1985 | |
| GB | 2 312 617 | | 11/1997 | |
| WO | WO 94/14357 | | 7/1994 | |
| WO | WO 95/26147 | | 10/1995 | |

* cited by examiner

*Primary Examiner*—Todd E. Manahan
*Assistant Examiner*—David Comstock
(74) *Attorney, Agent, or Firm*—Ohlandt, Greeley, Ruggiero & Perle, L.L.P.

(57) ABSTRACT

A cosmetics applicator assembly, especially a mascara brush, comprising a cap (8) to a container having a wiper (6) in its neck (3), has a stop (20) at the end of a rod (12), immediately above the applicator (14), the rod tapering towards the stop. The wiper is provided with fingers (22) which bear against the rod so that as the applicator is withdrawn from the container as the tapered portion passes them they relax until their ends contact the stop which inverts them as it passes, the fingers remaining inturned until the applicator passes them when they will revert to their relaxed state removing any blob of cosmetic from the end of the applicator.

15 Claims, 5 Drawing Sheets

MASCARA APPLICATOR ASSEMBLY HAVING INTURNING WIPER FINGERS

This application is a continuation-in-part of my application Ser. No. 09/149,578 filed Sep. 8, 1998, now U.S. Pat. No. 6,168,334 B1.

This invention relates to a material applicator and rod, more especially to an applicator and rod for a cosmetics material, for example, mascara or hair dye, and to an assembly comprising the applicator.

The assembly comprising the applicator normally comprises a container for the cosmetic, a closure cap attached by the rod to the applicator and located within the container a wiper plug or stripper having an orifice which, as the rod and applicator are withdrawn from the container, wipes the cosmetic from the rod and removes excess material from the applicator, leaving a desired quantity of material on the applicator.

Different designs of wiper have been proposed to try to ensure that the amount and distribution of material over the applicator are as required to give the desired effect on application. See for example, GB-A-2 097 662, GB-A-2312617 and EP-A-900 534. The wiper is required to remove material from the rod and excess material from the edge of the applicator and also desirably to remove any drop or thread of material from the free end of the applicator. The wiper may also control the quantity of material within the applicator when, for example, as is frequently the case with a mascara applicator, the applicator is a brush in which the mascara lies on, between and sometimes within the fibres of the bristles. Those wipers may comprise resilient fingers of a plastics or rubber material which extend inward from the material defining the orifice of the wiper. As the rod and applicator are withdrawn from the container the orifice of the wiper and/or the fingers, usually both, wipe material from the rod and then the applicator and finally the fingers close in and remove the drop or thread of material that is present at the end of the applicator.

While the wiper devices used are at least partially effective, they are still less than satisfactory. One problem they have is that they do not consistently remove the drop or thread of material from the free end of the applicator. A second problem that they have is that they tend to lose effectiveness over time and/or as a result of use. For example, where a wiper is of the type having resilient fingers, the relaxed diameter of the material defining the orifice is itself designed to be slightly less than the diameter of the rod, and the fingers extend inward from there. When the assembly is in its closed storage position, the material of the fingers is substantially deformed from its equilibrium configuration by the rod. The fingers have a tendency to set in the deformed position. In International Application WO 95/26147 it is proposed to alleviate this by providing the rod with an annular groove in the location contacted by the fingers. It has nonetheless been found that following prolonged storage the fingers do not close sufficiently onto the applicator as it is withdrawn through the wiper.

This tendency of the fingers to set in the deformed position (or, using other terminology, to lose their memory) is a significant disadvantage in that it restricts the shelf-life of the product and may inconvenience an infrequent user of a particular applicator unit.

Shorter fingers, as described in EP-A-900534, do appear to provide improved effectiveness over a longer period. They do not, however, eliminate the problem.

In DE-A-19744181 an applicator assembly is described which includes an applicator rod having a groove, in which the fingers of a wiper device, formed from a rubber type material, rest when the assembly is closed. The groove or stepped portion is formed by a narrowing of the rod via a sloping face to a straight sided narrow portion and then a broadening via a sloping face to its original width. In the closed position the rubber fingers rest with their tips in the groove. As the applicator rod is drawn through the wiper, the rubber fingers move against the broadening sloping side and their tips are turned inwards. The turned in tips of the fingers exert a greater wiping force on the rod and applicator. The assembly does, however, have the disadvantage that the turning in of the fingers may cause the material of the wiper to split as the rod is drawn through. A wiper made of a natural or synthetic rubber material may withstand the extra tension caused but the wiper fails if made from a thermoplastics type material.

In a first aspect, the present invention provides an applicator and rod suitable for use in an applicator assembly for applying a viscous material, the assembly comprising the applicator, the rod and a container, a closure means and a wiper device located within the container through which, in use, the rod and applicator may be drawn, the rod and the applicator each having a proximal end and a distal end, the distal end of the rod carrying the applicator by the latter's proximal end, and wherein (a) the rod has a constriction, the cross-sectional area of the rod between the part of the constriction having the smallest cross-sectional area and the distal end being less than that of the rod the proximal side of the constriction and the cross-sectional area of that part of the rod forming the distal side of the constriction being greater than the smallest cross-sectional area of the constriction or (b) the distal end of the rod tapers toward the applicator, there being positioned on the proximal end of the applicator a stop member, the cross-sectional area of the stop member being less than that of the rod on the proximal side of the tapered part but greater than the smallest cross-sectional area of the tapered part of the rod and, if there is any part of the applicator between the distal end of the rod and the stop member, greater than that part or (c) the proximal end of the rod has a greater cross-section than that of its distal end, the rod tapering from its greater cross-section to its lesser cross-section at a region of the rod closer to the proximal end than to the distal end, there being positioned on the proximal end of the applicator a stop member, the cross-sectional area of the stop member being less than that of the rod at the proximal end but greater than that of the rod on the distal side of the taper and, if there is any part of the applicator between the distal end of the rod and the stop member, greater than that part.

In a second aspect the invention provides a material applicator assembly comprising an applicator and rod according to the first aspect of the invention.

In a third aspect the invention provides a material applicator assembly comprising a container for a viscous material, a closure member, an applicator and rod according to the first aspect of the invention, the applicator being attached to the closure member by the rod, and, located within the container, a wiper device comprising a plurality of resilient fingers, advantageously positioned about the rod.

Advantageously, in embodiment (c) of the first aspect, the part of the rod with the taper is enclosed by the fingers of the wiper when the container is closed by the closure member.

The invention provides in a fourth aspect the use in a material applicator assembly comprising a wiper device comprising a plurality of resilient fingers and a rod carrying an applicator, of (a) a constriction in the rod to cause the resilient fingers of the wiper device to turn inward toward the rod as the rod is drawn through the wiper device and a cross-sectional area of the rod between the part of the constriction having the smallest cross-sectional area and the applicator of less than that of the rod before the constriction to inhibit or reduce failure of the material of the wiper device or of (b) tapering the rod carrying the applicator in the direction of the applicator and a stop member positioned on the proximal end of the applicator to cause the resilient fingers of the wiper device to turn inward toward the rod as the rod and applicator are drawn through the wiper device, the cross-sectional area of the stop member being less than that of the rod before the taper, to inhibit or reduce failure of the material of the wiper device.

The proximal end of the rod will normally be suitable for attachment to the closure device. Attachment may be by any suitable means, for example, by use of adhesives, or the rod and closure device may be integral.

The wiper device has an orifice which, as the rod and applicator are drawn through wipes the rod of excess material and also removes excess material from the applicator. As discussed above there are many different designs of wiper. The wiper usually comprises a resilient portion with an orifice that is a close fit around the rod. The material which defines the orifice acts as the wiping surface. The wiper may also comprise a plurality of resilient members or fingers extending inward from the material defining the orifice, on pillars which extend substantially parallel with the axis of the orifice or, preferably, directly from the orifice. A part of each finger then provides a wiping surface. This is usually in addition to the wiping surface provided by the material defining the orifice. It is wipers with resilient fingers that are used with the rod and applicator of the invention.

In the closed position, the applicator and applicator rod extend within the container from the closure cap. The wiper is in position about the applicator rod. Where the wiper comprises resilient fingers, in use, as the applicator rod is withdrawn from the container the wiping surfaces of the orifice and of the fingers bear resiliently against the rod and remove the viscous material from the rod until the fingers approach the constriction or the tapered end of the rod. As the rod is drawn past the fingers they are allowed by the narrowing of the constriction or the tapering to move towards their equilibrium position, i.e., the position they take up when not deformed by the rod, and then as the distal side of the constriction, where the cross-sectional area of the rod increases after the narrowest part of the constriction, is drawn through or as the stop member is drawn through the ends of the fingers are caused to turn inward toward the rod thus being forced more tightly into contact with the applicator rod or stop member than they otherwise would be. A different part of the finger now becomes the wiping surface.

The ends of the fingers are turned inward to an extent that they are turned back on themselves. As any remaining portion of the rod is drawn through and then as the applicator is drawn through the wiper the fingers remain turned inward and remove excess material from the applicator. When the end of the applicator is reached the fingers "flip" or "snap" back to their rest or equilibrium position. As this occurs the drop or thread of material at the tip of the applicator is removed.

The construction of the rod and applicator of the present invention at least partially alleviates the problem of material failure associated with that disclosed in DE-A-19744181. The portion of the rod or the stop member that must be wiped after the wiper parts have been turned in is narrower than the widest part of the rod and so there is less tension in the wiper material as the rod or stop member passes through the device. Accordingly, there is a much lower risk of material failure, for example, splitting, especially where the wiper device is formed from a thermoplastic material or a blend comprising a thermoplastic material.

When the rod has construction (a), the constriction comprises a narrowing of the applicator rod and then, toward the distal end of the rod, a widening of the rod out to give a portion with a cross-sectional area which is still less than the cross-sectional area of the rod before the narrowing. Between the narrowing section and the widening section there may be a narrow section of substantially constant cross-sectional area. The cross-sectional area of the rod from the narrowing of the constriction to the point at which it is joined to the applicator is less than that of the cross-sectional area of the rod before the constriction and preferably less than the cross-sectional area of the 360(orifice, in its equilibrium state, of the wiper with which it is to be used. If the rod were to be of greater cross-sectional area after the constriction then the stress exerted on the wiper once the fingers have been turned inward would be high and in many cases would cause it to fail, for example, by splitting.

When the rod has construction (b) or (c), the tapering of the rod performs the function of the narrowing of the constriction of the rod of construction (a) and the stop member performs the function of the distal side of the constriction, the broadening of the rod.

The stop member is positioned, more especially supported, on the proximal end of the applicator. It may be fixed firmly in place or may be loosely supported. The stop member may be a separate body supported on the applicator or it may be integral with the applicator or the rod, i.e., formed as part of the applicator or rod.

The narrowing or tapering of the rod may be rapid or more gradual. Preferably, the rod narrows down relatively gradually to allow the fingers to relax back towards their equilibrium position before they impinge on the shoulder as described below. For example, narrowing from a diameter in the range of from 2.5 to 5 mm to a diameter in the range of from 1.5 to 3 mm over a length of from 0.5 to 4.0 mm could be used.

For a rod of construction (a), the constriction comprises a narrowing of the rod and then a widening to form a shoulder or collar. For a rod of construction (b) or (c) the shoulder is provided by the stop member. As the rod is drawn through the wiper the fingers impinge on the shoulder and are forced inwards so that they are drawn backwards as the rod continues to be pulled through the wiper. The shoulder need not be exactly perpendicular to the axis of the rod but must be of steep enough incline to cause the required turning of the wiper parts. The acute angle, shown as θ in FIGS. 1 and 11, subtended between the line of the shoulder and the axis of the rod is preferably greater than 70°, more preferably greater than 80° and most preferably approximately 90°, that is the shoulder is approximately perpendicular to the axis of the rod. The angle may differ for use with different wipers. For example, if the material of the wiper is formed from a thermoplastic then the angle θ may need to be greater than if the wiper is formed from a rubber type material.

The shoulder or collar may be provided by any suitable shaping of the rod or stop member. For example, the constriction may comprise a narrowing of the rod followed by a small hemispherical portion or the stop member may be a small solid hemisphere. In either case, the flat circular face forms the shoulder and the cross-sectional area of the circular face is less than that of the rod before the constriction or tapering. In an alternative embodiment, the shoulder may be formed by the larger circular face of a frustum of a cone or of a solid cup shape (a frustum of a cone but with a bulbous curved surface rather than a truly conical surface).

The constriction may be situated at any position on the rod between the rest position of the wiper device's fingers, i.e., the position where the fingers contact the rod when the applicator assembly comprising the rod is in the closed position, and the distal end of the rod. Preferably the constriction is further towards the distal end of the rod than the rest position and most preferably the constriction is near or at the distal end of the rod.

The above applies equally to the embodiments in which a stop is provided; accordingly in embodiment (c), in which the main part of the length of the rod is of narrower cross-section, that part of the rod will not be so completely cleaned as in embodiment (a) or (b); this configuration is, however, simpler to construct.

If the constriction is too far from the distal end of the rod then the wiping of the rod thereafter may not be clean. When the wiper comprises fingers attached directly to the orifice of the wiper then as the fingers are turned inward and back on themselves they may come between the wiping surface of the orifice and the rod so that the wiping surface of the orifice is no longer in direct contact with the rod. Hence from that point on wiping of the rod only occurs in those places where the fingers touch the rod and so some parts will not be wiped. Hence, in such a case it is extremely advantageous for the constriction, i.e., the narrowing of the rod and the shoulder or collar, to be close to, or at, the distal end of the rod.

The cross-sectional area of the shoulder and the remaining part of the rod or of the stop member is governed by two requirements. The first is that it be large enough for the fingers to impinge upon even if the material of which they are made has lost some memory and they do not relax back to the full extent allowed by the narrowing of the constriction or the tapering of the rod. The second is that the fingers must be allowed to turn back on themselves without causing significant enlargement of the orifice of the wiper as such enlargement could lead to splitting of the material of the wiper.

For the avoidance of doubt, the cross-sectional area of the rod or stop member that is to be considered is the area of the cross-section at the relevant part perpendicular to the long axis of the rod (that axis is shown in FIGS. 1 and 11 by a broken line).

If the cross section of the rod, the wiper orifice and the shoulder are circular, as they typically will be, then the diameter of the shoulder is preferably approximately the diameter of the wiper orifice minus twice the thickness of one of the resilient fingers. Typically the diameter of the shoulder will be at least 0.6 to 1.0 mm less than that of the wiper orifice.

There are two sizes of rods commonly used in cosmetics applicator assemblies. The rods are of circular cross section with a diameter of 4.3 mm or 3.5 mm. The resilient fingers of a thermoplastic wiper may typically be of maximum thickness of 0.4 to 0.5 mm tapering down to about 0.25 mm at the tips. For use with a 4.3 mm diameter rod the wiper has a circular orifice of diameter 4.2 mm hence the shoulder should preferably have a circular cross-sectional area with a diameter of about 3.2 to 3.4 mm, especially 3.3 mm. If a 3.5 mm rod is used then the wiper has a 3.4 mm diameter orifice and the shoulder should have a diameter of about 2.6 mm.

The narrowest part of the constriction or of the tapered rod must obviously be of a lesser diameter than that of the shoulder and is preferably substantially narrower, for example, it may have a circular cross-section with a diameter of from 1.5 to 3 mm.

In one version of embodiment (c) the wider and narrower portion of the rod may advantageously have diameters of 4.8 and 3.0 mm respectively, while the stop has a diameter of 4.0 mm.

The rod according to the invention may comprise a groove at the rest position of the wiper fingers, as described in WO95/26147, to reduce the deformation of the wiper during storage. If desired the groove and the constriction can be combined as one and the same but this is not preferred.

The rod may be formed from any suitable material, for example, it may be formed of a thermoplastic material.

The applicator will preferably be a brush, especially a brush consisting of a helix of bristles around a core or support, often formed from a twisted steel wire, but may be of a different type, for example, a foam applicator. When the brush is on a support, the cross-section of the support is advantageously less, and preferably considerably less, than that of the distal end of the rod in embodiment (a) and of the stop in embodiments (b) and (c). The cross-section is advantageously substantially uniform, subject of course to the irregularities inherent in a twisted wire support. The diameter of the orifice of the wiper device is generally smaller than the maximum diameter of the applicator. If the applicator is a brush then the diameter is measured from the tips of the bristles.

The wiper device may be formed of a thermoplastic, elastomeric, or thermoplastic elastomeric material, for example, a synthetic or natural rubber, a polyurethane, an olefinic homo- or co-polymer, e.g., polyethylene, especially low density polyethylene, or an ethylene-unsaturated ester copolymer, for example, an ethylene-vinyl acetate copolymer. The device may be formed of a laminate or blend of two or more such materials. If a thermoplastic material is used then it may include a cross-linking agent. Preferably, the wiper device is formed of a thermoplastic material or of a blend comprising a thermoplastic material. Wiper devices formed from thermoplastics materials or blends comprising a substantial proportion of thermoplastics materials have advantages, for example, relatively low cost compared with rubber materials. They do, however, have disadvantages, such as loss of resilience and the possibility of material failure as discussed above. The applicator and rod of the present invention are especially advantageous when used with a wiper device formed from thermoplastic material or a blend comprising thermoplastic material as those problems are at least partially alleviated. Preferred materials are 100% low density polyethylene and 100% thermoplastic elastomeric material (TPE), for example, a thermoplastic elastomeric material having a shore hardness in the range of from D40 to D60. Thermoplastic elastomeric materials are more resilient than materials such as polyethylene.

A preferred wiper device suitable for use with the rod and applicator of the invention and in the cosmetics applicator assembly of the invention comprises an elongate hollow resilient body having a substantially circular orifice, and positioned around and extending directly from the periphery of the orifice a plurality of elongate resilient members (the resilient fingers), each having a free, distal, end portion, each member extending inward toward the axis of the orifice and away from the body, each member being at an angle within the range of from 90° to 120° to the axis and tapering toward the distal end, the members being radially spaced apart at least at their distal ends, and preferably occupying at most 55%, most preferably 50%, of the area of the orifice as viewed axially. More especially, the wiper is one having four elongate resilient members, at an angle of at least about 100° to the axis, the distance between a pair of opposed distal ends being at most 10% of the diameter of the orifice. Wiper devices of that type are described in EP-A-900 534. It will be appreciated that when the rod is of narrow diameter, for example 3.5 mm, engineering considerations may not allow such a close approach, the minimum practical spacing being about 0.4 mm. Accordingly this spacing may then represent up to 15 or 20% of the orifice diameter.

It will be appreciated that the orientation of the members defined above is that adopted when the wiper device is in its relaxed or equilibrium configuration, i.e., in the absence of deformation by, for example, the rod of a cosmetics material applicator. When the wiper is in position about a rod not having a groove at the rest position, the members will extend along the rod, bearing resiliently against it.

In operation, accordingly, as the applicator rod is withdrawn from a container in which such a wiper is fitted, with the end of the wiper carrying the members facing away from the container opening, the edge or face of the wiper orifice will remove viscous material from the rod and control the quantity of material remaining on the applicator, the elongate members bearing resiliently against the rod as it passes by until the constriction or stop member is reached, whereupon the ends of the elongate members are turned back on themselves to an inward position. When the applicator begins to pass the members the ends remain turned inward and the members may also be drawn backward into the brush by the action of the fibres. As the free end of the applicator passes, the members spring out, removing at least part of the drop of material from the end of the applicator.

It will be appreciated that where the applicator is a brush the elongate members will recover toward their equilibrium configuration by intermingling with the brush fibres to a greater or lesser extent as the brush passes them, the extent depending on the flexibility of the members and the nature of the brush, which advantageously is one having radially extending bristles.

To achieve the desired wiping effect the tips of the resilient fingers of the wiper should penetrate into the brush as far as possible. Their tips should be as close to the central core of the brush, usually a twisted wire, as possible. Fingers that are turned inward as they meet the brush, as in the present case, penetrate the brush better and get closer to the wire than wiper fingers that have not been turned back on themselves. As the brush is drawn through the wiper the bristles do not usually exert enough pressure on the fingers to keep them turned completely turned back on themselves so the ends do unfold. There is sufficient pressure, however to stop the fingers from returning to their equilibrium positions. They are generally allowed to unfold until the fingers are approximately perpendicular to the core of the brush. The force exerted by the passing bristles is then sufficient to maintain them in that position and it is that position that achieves the desired wiping of the brush.

A typical twisted wire brush for use with mascara or similar viscous cosmetic material has from 40 to 400, more usually 170 to 300, bristles or fibres per cm, with bristles or fibre thickness being in the range 0.06 to 0.25 mm, the number of twists in the wire typically being from 4 to 7 per cm. (The fibre count is half the number of bristle ends.)

It has been found that optimum interaction between the fibres and the wiper, ensuring that the wiper fingers are turned inward as they meet the brush, is achieved when the fibre count is toward the lower end of the typical range while the fibre thickness and hence stiffness is toward the upper end of the typical range. Preferably, the brush has from 160 to 200 fibres per cm, the fibres being of diameter in the range 0.125 to 0.2 mm. The relatively low fibre count, in combination with a relatively stiff fibre, allows easy combing of the brush through eyelashes.

In another preferred embodiment, the fibres for the first 3 to 6 mm length of brush at the proximal end, i.e., the end first encountered by the wiper, are about 0.25 mm diameter, while the remainder of the brush, typically 20 to 25 mm in length, beyond the first two to four twists, uses more flexible fibres, for example of about half that, e.g., about 0.125 mm, to allow easy combing in use. More preferably, the fibre density is from 160 to 200 per cm.

Using a preferred brush as described above, the resilient fingers of the wiper are reliably turned inward even if there has been some set during storage, despite the provision of a groove in the rod. Brush manufacturing equipment may be adjusted as required to pick up the desired density of fibres from the supply. The number of fibres per unit length may be varied by adjusting, for example, the spacing of the transfer means, usually teeth. For the embodiment where there are fibres of two different thicknesses the number of fibres in the strand or rope feed may be varied.

In all cases, whatever stiffness and density of bristles are used, the ends of the resilient fingers will tend to return toward their equilibrium configurations as the applicator end approaches, and will "flick" or snap back as this stage of withdrawal, assisting in removing the final drop from the applicator. Providing the applicator with a tapered free end will usually make drop removal even more effective.

Advantageously, the wiper device is preferably provided with from three to five, preferably four, fingers. The spacing between the fingers or members advantageously increases from their proximal to distal ends, i.e., the free end of each member will subtend a smaller angle viewed along the axis of the orifice than does the proximal end, and if desired the extremities of the proximal ends of the members may merge to be in contact. Advantageously, however, the proximal ends are spaced apart, and may occupy at most 55%, more especially 50%, of the circumferential length of the orifice. Advantageously, the distal ends of the members taper, i.e., are roughly triangular. The wider proximal portions provide an enhanced resistance to deformation set or twist while the tapering distal end portions are flexible so as to allow them to be turned inward and to enhance removal from the free end of the applicator (which is normally tapered) of any adherent blob of material as it is withdrawn past them but do not remove significant quantities of the material from the length of the applicator, for example, from the bristles if the applicator is a brush, as it is withdrawn.

Advantageously, when the wiper is viewed along the axis in its relaxed configuration, the fingers or elongate members occupy at most 55%, preferably, 50%, more preferably from 40 to 50% and, most preferably about 45%, of the area of the wiper orifice. Also, advantageously, the distance between a pair of opposed distal ends is at most 25% of the diameter of the orifice, preferably at most 20%, and more preferably at most 10%. In principle, the distal ends of the members may be in contact but such a construction is not readily achieved by the presently preferred manufacturing process.

However, advantageously the lengths of the wiper members, relative to the size of the wiper orifice, and their rest angle are such that as they spring out they touch, maximizing the proportion of the drop that is removed. Such a result is achieved, for example, with an angle of from 100° to 120° and a separation in the rest position of less than 10%.

Referring again to the fingers or elongate members in their relaxed configuration, each advantageously comprises a proximal portion that tapers toward the distal end either as seen along the axis of the aperture, or as seen transverse to the axis, or, preferably, as seen in both such directions. Advantageously, the proximal portion of the member itself is of rectangular cross-section. The distal portion of each member advantageously tapers toward the distal end as seen along the axis of the aperture, or as seen transverse to the axis or, preferably, as seen in both such directions. Advantageously, the distal portion of the member is of rectangular cross-section, except for the distal end itself, which is advantageously triangular, as will be described in more detail with reference to the drawings. The member advantageously tapers regularly from one end to the other. Each member is advantageously generally straight in its undeformed configuration.

A wiper device also suitable for use with the present invention may comprise a resilient body having a substantially circular orifice, and spaced apart around the periphery of the orifice a plurality of elongate resilient members (the fingers), each having an end portion proximal to the body and a free, distal end portion, the proximal end portion extending from the body in a direction having at least a substantial component parallel to the axis of the circular orifice, the free distal end portions of the members extending inward toward the axis and the distal ends being at or close to the axis. Such wiper devices are described in GB-A-2312617.

In a preferred embodiment, the applicator assembly is suitable for use for applying a viscous material, the assembly comprising a container for the viscous material, a closure member, an applicator and rod, and a wiper device located within the container through which, in use, the rod and applicator may be drawn, the wiper device comprising an elongate hollow resilient body having a substantially circular orifice, and positioned around and extending directly from the periphery of the orifice a plurality of elongate resilient members, each having a free, distal, end portion, each member extending inward toward the axis of the orifice and away from the body, each member being at an angle within the range of from 90° to 120° to the axis and tapering toward the distal end, the members being radially spaced apart at least at their distal ends, and occupying at most 55%, preferably at most 50%, of the area of the orifice as viewed axially, and the rod comprising a proximal end attached to the closure member and a distal end attached to the applicator and comprising near to or at the distal end a constriction, the cross-sectional area of the rod between the part of the constriction having the smallest cross-sectional area and the distal end being less than that of the rod the proximal side of the constriction and the cross-sectional area of that part of the rod forming the distal side of the constriction being greater than the smallest cross-sectional area of the constriction, the rod further comprising a groove at the point of contact, in the closed position of the assembly, of the elongate members of the wiper device.

Two forms of applicator, rod and assembly device constructed in accordance with the invention and several suitable wiper devices will now be described in greater detail, by way of example only, with reference to the accompanying drawing(s) in which:

FIG. 1 shows a longitudinal section through an applicator assembly, in a closed position, constructed in accordance with the invention, FIG. 2 shows a longitudinal section through the applicator assembly of FIG. 1 as the applicator rod is being drawn through the wiper device, FIG. 3 shows a longitudinal section through the applicator assembly of FIG. 1 as the applicator is about to be drawn through the wiper device, FIG. 4 shows a longitudinal section through a first wiper device which may be used in the assembly of the invention, FIG. 5 shows a plan view of the device of FIG. 4, FIG. 6 shows a part of FIG. 4 enlarged to show details of the resilient members, FIG. 7 shows a longitudinal section through a second wiper device which may be used in the assembly of the invention;

Figure 1:
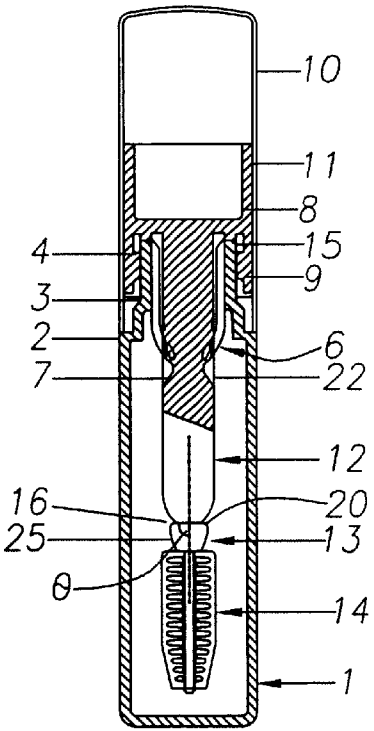

Referring to FIG. 1, an applicator assembly, in particular a mascara unit or hair dye unit, is shown. The unit comprises a thermoplastics container indicated generally by the reference numeral 1 having a neck portion 3 with an external thread 4 joined to the body of the container by a shoulder 2.

A cap 8, the closure device, with an internal thread 9 is fitted onto the external thread 4 of the neck 3, an outside cover 10 being held in position over the cap 8 by a heat-setting adhesive layer 11, or simply by a force fit. Extending from the cap 8 into the interior of the container 1 is a rod 12, to the lower end 13 of which is attached an applicator brush 14. A wiper device indicated generally by the reference numeral 6 having a rim 15 is located in the neck 3, the rim 15 providing a seal 5 between the container 1 and the cap 8.

The wiper device 6, discussed in greater detail below, is located in the neck 3. When the assembly is closed, as shown in FIG. 1, the rod 12 extends from the cap 8 through the wiper device 6 and the wiping surface 18 is in contact with the rod 12. Fingers 22 of the wiper extend downwards into the container 1 and rest on the rod. In preferred embodiments a groove 7 is provided in the rod 12 and the fingers 22 rest in the groove. In the embodiment shown in FIG. 1 the sides of the groove slope relatively shallowly to allow the fingers to expand outwards gently as the rod 12 is removed from the container.

At the distal end of the rod 12, just before it is joined to the applicator brush 14, the rod narrows at the constriction 16 and then broadens sharply by means of a surface or shoulder 20 provided by the circular face of a solid cup shaped part 25 (a frustum of a cone but with a bulbous rather than a strictly conical surface). The diameter of the shoulder and of the remaining portion of the rod is, however, less than the diameter of the rod at its widest part and is, preferably, less than the relaxed diameter of the orifice of the wiper 6. The shoulder 20 subtends an angle $\theta$, to the axis of the rod 12. In FIG. 1 $\theta$ is 90°.

Figure 3:
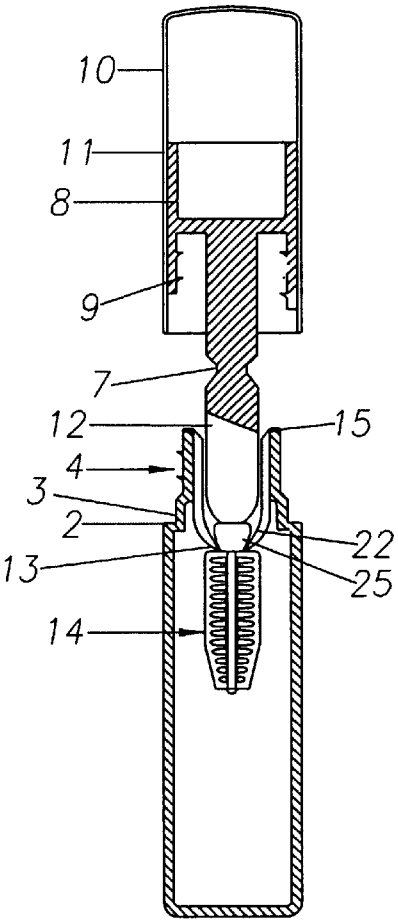
Figure 2:
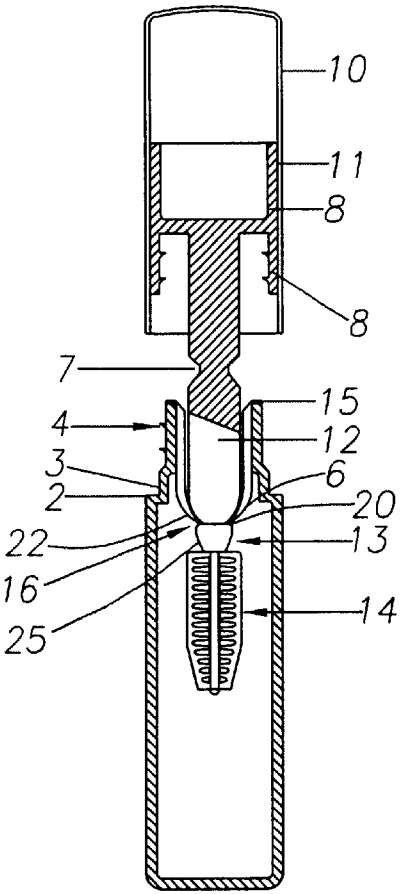

As the rod 12 and applicator brush 14 are withdrawn from the container 1 as illustrated in FIGS. 1 and 2, the fingers 22 gently bear against the rod or rest on its surface until they reach the narrowing section 16. As they pass the narrowing section 16 they relax inwards towards their equilibrium state and then their ends are brought into contact with the surface 20 as in FIG. 2. The movement of the surface 20 against the end of the fingers 22 causes them to turn inwards so that they are turned back on themselves as shown in FIG. 3. The ends remain turned in as the rest of the rod 12 and applicator 14 are withdrawn.

Figure 4:
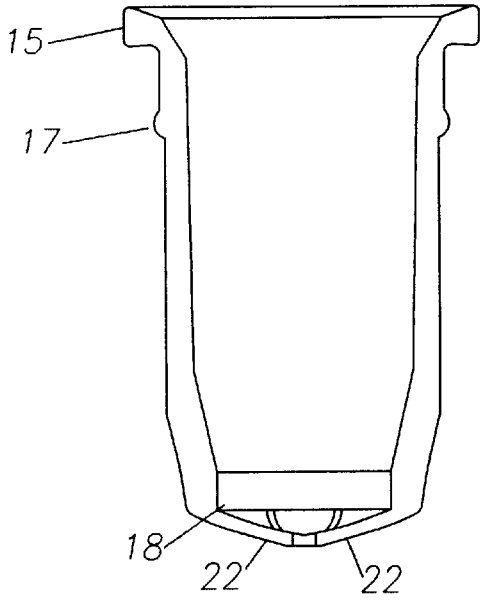
Figure 5:
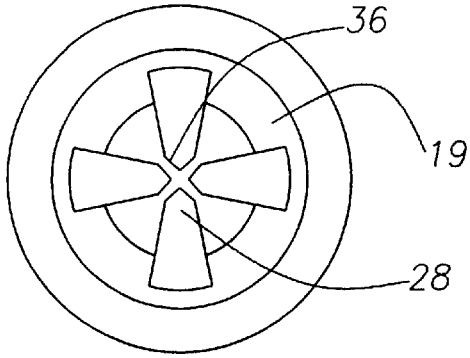
Figure 6:
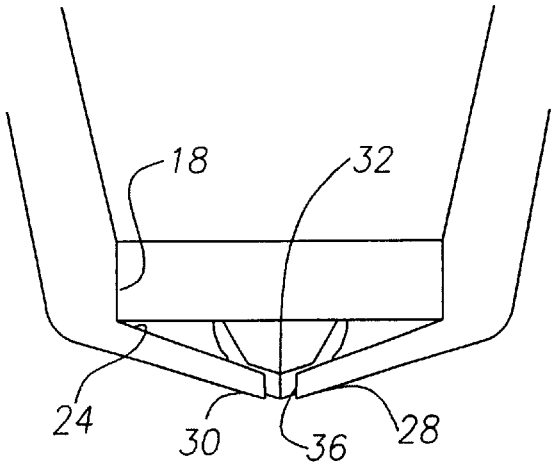

Referring now more especially to FIGS. 4, 5 and 6, the wiper device 6 is shown in more detail. As indicated above, it has at its upper end a rim 15 which, in addition to providing a seal, forms a stop to locate the device 6 in the neck 3, and a bead 17 on the outside wall of the body just below the rim 15 serves to engage with a corresponding recess in the inside wall of the neck 3 and assist in sealing and ensuring a secure fit. The external and internal surfaces of the wall of the body of the device are angled inwards so that the device tapers toward its lower end wall 19, the internal wall surface terminating in a wiping surface 18 occupying 360° of arc. Extending from the lower end wall 19 are four spaced apart wiping fingers 22 extending toward the axis. As may be seen most clearly from FIG. 5, each finger 22 tapers toward the free, distal, end 28. The fingers 22 are of rectangular cross-section, all faces of the rectangle becoming smaller with approach to the free, distal, end 28. The angle between the inner face 24 of each finger 22 and the wiping surface 18 (which is parallel to the axis of the device 6) is about 100°. The outer face 30 and the inner face 32 of the terminal section of the distal end 28 are pointed, the faces 30 and 32 being offset to provide an edge 36 parallel to and slightly away from the axis of the device 6. The four fingers occupy about 45% of the area of the orifice defined by the wiping surface, when viewed axially, as seen in FIG. 5.

Typically, the diameter of a mascara applicator rod is within the range of 2.5 to 4.5 mm. For a 4.3 mm rod, the diameter of the wiping orifice may be about 4.2 mm, the length of the fingers measured along the inner face being 2.0 to 2.2 mm, the edges 36 of diametrically opposed fingers being about 0.25 mm apart. As examples of materials from which the wiper may be constructed, there may be mentioned a low density polyethylene, a low density polyethylene/thermoplastic elastomer blend, for example in proportions of about 1:2 by weight, a thermoplastic elastomer and wholly elastomeric materials, for example a nitrile rubber, for example an elastomeric material with a Shore hardness in the range of 70 to 80.

Figure 7:
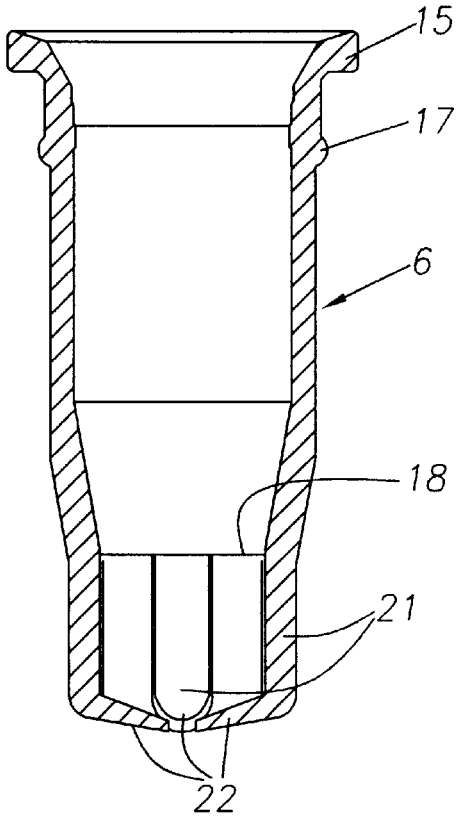
Figure 8:
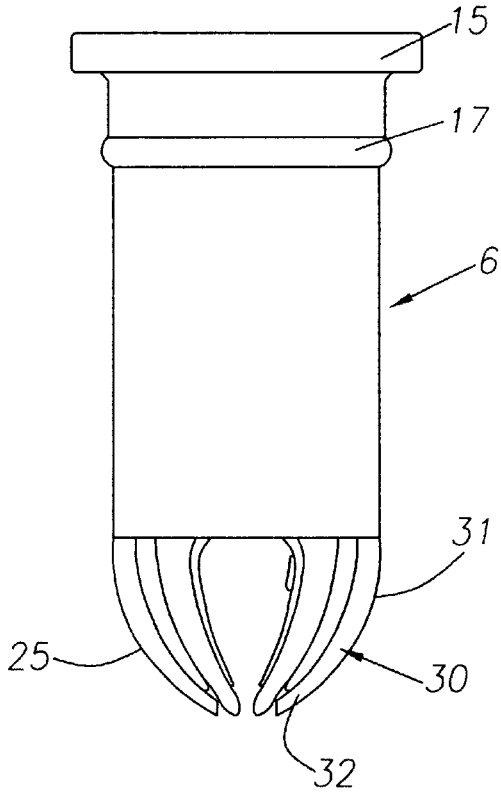
FIG. 8 shows a plan view of the device of FIG. 7.

A suitable wiper of similar construction but having longer elongate members is shown in FIGS. 7 and 8. Features corresponding to those of FIGS. 5 and 6 are given corresponding reference numerals. The upper part of the device is as described above and tapers at its lower end, the internal wall terminating in a wiping edge 18. Extending parallel to the axis of the device from the lower end wall are four spaced apart elongate pillar members 21, from each of which a wiping finger 22 extends toward the axis. The extremities 23 of the fingers 22 are rounded to enable them to approach the centre of the applicator brush 14 as closely as possible on withdrawal of the brush. In order to minimize the extent of the deformation of the pillars and fingers when the applicator rod 12 is in its storage position, an annular groove 7 (see FIG. 1) may be formed in the rod at the appropriate location.

The fingers 22 extend at an angle of about 100° to the pillar members 21.

Typically, the diameter of a mascara applicator rod is within the range of 2.5 to 4.5 mm. For a 4.3 mm rod, the diameter of the wiping orifice may be about 4.2 mm and the length of the pillars about 3.6 mm, the fingers each extending about 2.0 mm from the internal wall of the pillars.

Figure 9:
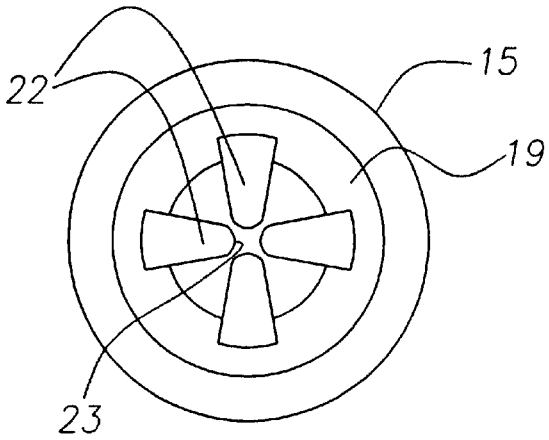
FIG. 9 shows a longitudinal section through a third wiper device which may be used in the assembly of the invention.
Figure 10:
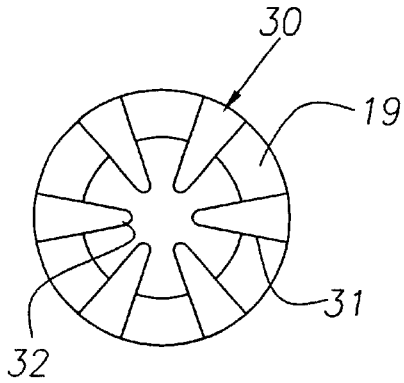
FIG. 10 shows a plan view of the device of FIG. 9.

Referring now to FIGS. 9 and 10, in which features corresponding to those of FIGS. 7 and 8 are given corresponding reference numerals, a third embodiment of a suitable wiper device is shown, in which the body portions are like those of FIGS. 7 and 8. Extending from the lower end wall 19 of the body of the wiper device 6 are six spaced apart members indicated generally by the reference numeral 30, the proximal portions 31 of each member extending parallel to the axis of the device and the distal end portions 32 extending inward at an angle of about 130° to the axis, intermediate portions 33 providing a smooth curve between the end portions. As in the embodiment shown in FIGS. 7 and 8, the members extend as close to the axis as is consistent with their being capable of being removed from a mould during manufacture. In both embodiments shown in FIGS. 7 to 10, the material of which the devices are constructed is resilient, and the proximal portions 21 and 31 of the members assist in inhibiting amnesia under deformation.

Figure 11:
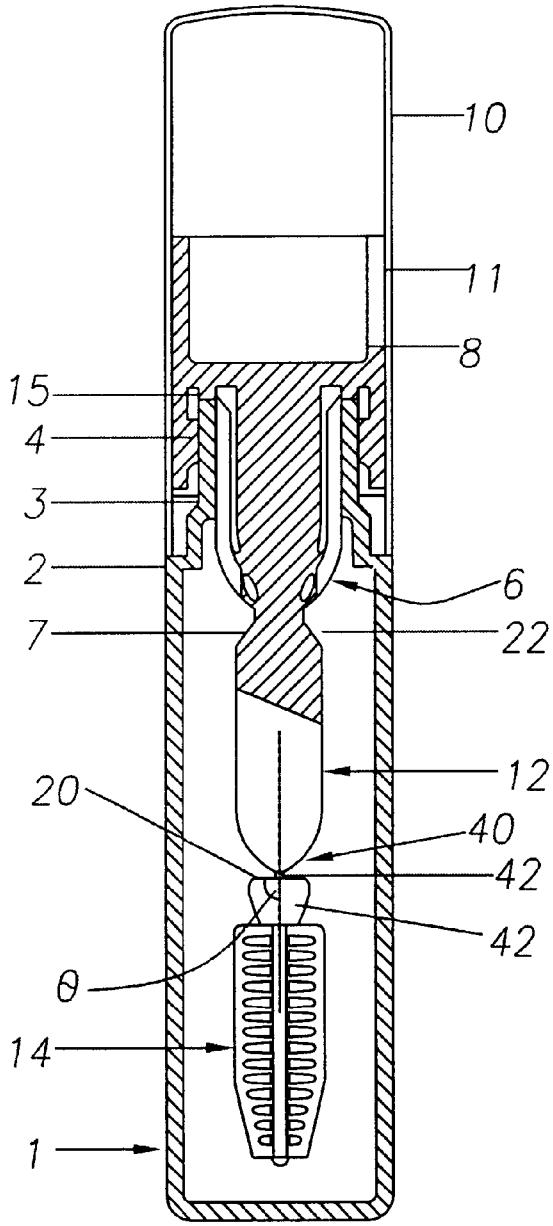
FIGS. 11 and 12 show longitudinal sections through second and third applicator assemblies, in a closed position, constructed in accordance with the invention.

FIG. 11 shows an applicator assembly identical in construction to that of FIGS. 1 to 3 in all but the construction of the rod and applicator. Features corresponding to those of FIGS. 1 to 3 are given corresponding reference numerals.

The distal end 40 of the rod 12 tapers towards the applicator 14. Supported on the end portion 42 of the applicator 14 is a stop member 44 which provides a shoulder 20. As the rod 12 and applicator brush 14 are withdrawn from container 1, the fingers 22 gently bear against the rod or rest on its surface until they reach the tapering end 40 of the rod 12 and the end portion 42 of the applicator where they relax towards their equilibrium state. Their ends are then brought into contact with surface 20 and the movement of surface 20 against their ends causes the fingers 22 to turn inwards so that they are turned back on themselves.

The applicator brush 14 may, for example, comprise a helix of bristles supported by a core comprising a twisted steel wire, in which case the end portion 42 may be formed by the twisted steel wire.

Figure 12:
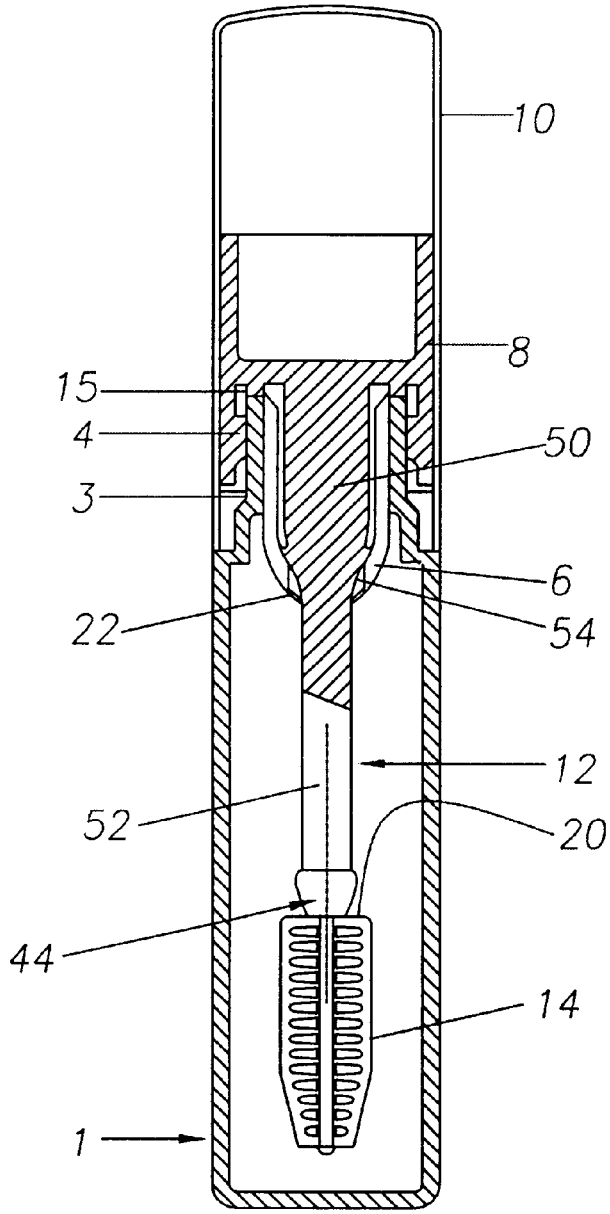

FIG. 12 shows a further applicator assembly similar in construction to that of FIG. 1. In the FIG. 12 embodiment, however, only the portion 50 of the rod 12 within the wiper device 6 when the container is closed is of a wider diameter, the remaining portion 52 being of a uniform smaller diameter, a tapered portion 54 linking the portions 50 and 52 lying under the fingers 22 of the wiper 6 when the closure device 8 is screwed onto the thread 4 on the neck 3 of the container 1. The taper 54 is ogee shaped in this and the other embodiments and located so that the fingers 22 rest on the convex portion.

When withdrawal of the rod begins, the fingers move to the concave portion with no tendency to invert at this stage. However, advantageously as the rod 12 and the applicator brush 14 are withdrawn further, the fingers 22 will be inverted by the shoulder 20 of the stop member 44.

What is claimed is:

1. An applicator assembly that is insertable into a container that carries a viscous material and that has a wiper device for regulating the amount of viscous material that said applicator assembly retains when withdrawn from said container, said wiper assembly having a plurality of fingers that extend toward and engage said applicator assembly when being withdrawn from said container, said applicator assembly comprising:

a rod and an applicator disposed on a distal end of said rod;

said rod further comprising a groove at a point of contact of said fingers when said applicator assembly is fully inserted in said container;

wherein said rod includes a solid cup shaped portion that has a first end disposed adjacent said applicator and an opposed end that has a shoulder surface having a shoulder end, and wherein, when said applicator assembly is withdrawn from said container, said shoulder end engages and turns said wiper fingers back upon themselves.

2. The applicator assembly as claimed in claim 1, wherein a portion of said rod adjacent said shoulder surface narrows in a constriction.

3. The applicator assembly as claimed in claim 2, wherein said shoulder surface subtends an angle greater than 70° to an axis of said rod.

4. The applicator assembly as claimed in claim 3, wherein said shoulder surface is approximately perpendicular to said axis of said rod.

5. The Applicator assembly as claimed in claim 4, wherein said shoulder surface is circular.

6. The applicator assembly as claimed in claim 4, wherein said shoulder is formed by a larger circular face of a solid frustrum of a cone.

7. The applicator assembly as claimed in claim 1, wherein said applicator is a brush having bristles extending from a twisted wire core, said brush comprising from 160 to 200 bristles per cm, said bristles being of a diameter within the range 0.125 to 0.2 mm.

8. The applicator assembly as claimed in claim 1, wherein said applicator is a brush having bristles extending from a twisted wire core, said brush comprising a proximal portion of length from 3 to 6 mm having bristles of about 0.25 mm diameter, a remainder of said brush comprising bristles of about half said diameter of said proximal portion bristles.

9. The applicator assembly as claimed in claim 8, wherein said bristles have a density from 160 to 200 per cm.

10. An applicator assembly suitable for use for applying a viscous material, the assembly comprising a container for the viscous material, a closure member, an applicator and rod as claimed in claim 1, the applicator being attached to the closure member by the rod, and, located within the container, a wiper device comprising a plurality of resilient fingers.

11. The applicator assembly as claimed in claim 1, wherein said wiper device comprises an elongate hollow resilient body having a substantially circular orifice, said fingers being positioned around and extending directly from a periphery of said orifice toward an axis thereof and being elongate and resilient, each of said fingers having a free, distal, end portion and being at an angle within a range of from 90° to 120° to said axis and tapering toward said distal end portion, said fingers being radially spaced apart at least at said distal ends thereof, and occupying at most 55% of an area of said orifice as viewed axially.

12. The applicator assembly of claim 11, wherein there are four of said fingers each being at an angle of at least about 100° to said axis, and wherein a distance between a pair of opposed distal ends of said fingers is at most 10% of the diameter of said orifice.

13. The applicator assembly as claimed in claim 1, wherein said rod has a substantially circular cross-section, wherein said wiper device comprises a hollow resilient body having a substantially circular orifice, and wherein a diameter of said cup shaped portion is less than or equal to that of said circular orifice of said wiper device when in an equilibrium position minus twice a thickness of one of said fingers.

14. The applicator assembly of claim 1, wherein the diameter of said cup shaped portion is equal to or less than the diameter of a widest portion of said rod.

15. An applicator assembly that is insertable into a container that carries a viscous material and that has a wiper device for regulating the amount of viscous material that said applicator assembly retains when withdrawn from said container, said wiper assembly having a plurality of fingers that extend toward and engage said applicator assembly when being withdrawn from said container, said applicator assembly comprising:

a rod and an applicator disposed on a distal end of said rod;

a groove disposed in said rod at a location such that when said rod is fully inserted in said container, said fingers are situated in said groove;

wherein said rod includes a solid cup shaped portion that has a first end disposed adjacent said applicator and an opposed end that has a shoulder surface having a shoulder end, and wherein, when said applicator assembly is withdrawn from said container, said shoulder end engages and turns said wiper fingers back upon themselves.

* * * * *